United States Patent [19]

Schade

[11] Patent Number: 4,652,709

[45] Date of Patent: Mar. 24, 1987

[54] GAS BLAST SWITCH

[75] Inventor: Ekkehard Schade, Wettingen, Switzerland

[73] Assignee: BBC Brown Boveri & Co., Ltd., Switzerland

[21] Appl. No.: 739,622

[22] Filed: May 31, 1985

[30] Foreign Application Priority Data

Jun. 7, 1984 [CH] Switzerland ..... 2772/84

[51] Int. Cl.[4] ..... H01H 33/70

[52] U.S. Cl. ..... 200/148 R; 206/148 B

[58] Field of Search ..... 200/148 R, 150 B, 150 M, 200/148 B

[56] References Cited

U.S. PATENT DOCUMENTS 3,584,171 6/1971 Pucher ..... 200/150 B
4,139,752 2/1979 Itai et al. ..... 200/148 R

FOREIGN PATENT DOCUMENTS 1127442 4/1962 Fed. Rep. of Germany ... 200/150 M
1127443 4/1962 Fed. Rep. of Germany ... 200/150 B

*Primary Examiner*—Robert S. Macon

*Attorney, Agent, or Firm*—Ostrolenk, Faber, Gerb & Soffen

[57] ABSTRACT

A gas blast switch, preferably for switching medium voltages, has two cylindrical contacts movable relative to one another along the cylinder axis in a casing filled with extinguishing gas. The contacts are coaxially surrounded by a hot space. The hot space serves to accept extinguishing gas which is heated by a switching arc. The heated extinguishing gas is led, via an annular gap, into the hot space where it is stored to be mixed with fresh extinguishing gas and to thereafter produce effective blasting of the switching arc. The extinguishing gas which is not cooled with a cooling device, still provides gas temperatures which are substantially below the temperature of the heated extinguishing gas. This is achieved in one embodiment by a radially extending annular duct having a width (B) which is small in comparison to the axial longitudinal extension (L) and the radial depth (D) of the hot space. Further, the axial longitudinal extension (L) and the radial depth (D) of the hot space, both measured from the entry or boundary of the annular duct into the hot space, are approximately equal to one another.

10 Claims, 3 Drawing Figures

GAS BLAST SWITCH

BACKGROUND AND SUMMARY OF THE INVENTION

The present invention is directed to a gas blast switch.

The invention refers to a gas blast switch of the type described in FIG. 1 of the U.S. Pat. No. 4,139,752. In the known switch, extinguishing gas heated by the switching arc is stored in a toroidal shaped hot space coaxially surrounding the contacts and radially blasts the switching arc when the heating effect of the switching arc decreases as the current to be interrupted approaches a crossover. In order to obtain a blasting of the switching arc which is as effective as possible, a cooling device is provided in the annular duct. The temperature of the extinguishing gas used to blast the switching arc is reduced by the cooling device when passing through the annular duct. A cooling device is, however, relatively expensive and makes the flow of the extinguishing gas more difficult, both into the hot space during the high current phase and out of the hot space when the current to be interrupted approaches a crossover.

The invention, as characterised in the claims, satisfies the objective of providing a gas blast switch of the generic type but in which the extinguishing gas provided for blasting the switching arc is, even without the use of a cooling device, available at gas temperatures quite substantially below the temperature of the heated extinguishing gas.

The gas blast switch in accordance with the invention is characterised by high extinguishing capability and simple construction. This is due to the fact that the extinguishing gas heated by the switching procedure generates, in the hot space, a circulation flow by means of which the heated extinguishing gas and the cool extinguishing gas located in the hot space are very rapidly mixed.

BRIEF DESCRIPTION OF THE DRAWINGS

The invention is described in more detail below in relation to the drawings.

DETAILED DESCRIPTION OF A PREFERRED EMBODIMENT

Figure 1:
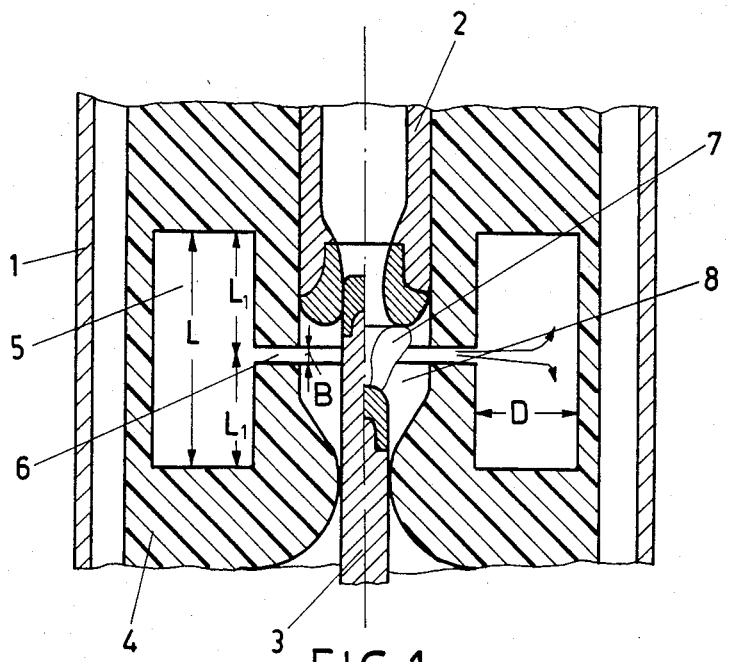
FIG. 1 shows a view of a first embodiment of a gas blast switch in accordance with the invention which is shown in a section along the axis of its contacts.

In the figures, the same parts are provided with the same reference designations and, in each case, the left-hand part shows the gas blast switch in the engaged position and the right-hand part shows it during disengagement.

In the figures, there is shown a casing 1 filled with an extinguishing gas, such as sulphur hexafluoride at a pressure of a few bar. In casing 1 is located a fixed contact 2, a moving contact 3 and an insulation body 4. A toroid-shaped hot space 5 surrounding the contacts 2 and 3 is enclosed in the insulation body 4 and an annular duct 6 emerges into the hot volume 5. The annular duct 6 connects the hot space 5 to an arc extinguishing zone

8 which is formed on switching off between the separating contacts 2 and 3 and accepts a switching arc 7. The hot space 5 has an axial extension L and a radial depth D and is bounded by two coaxially and two radially extending walls. The annular duct 6 has a width B which is small in comparison with the axial longitudinal extension L and the radial depth D of the hot space 5. Its outlet flow area is larger or, at the maximum, equal to the sum of the outlet flow areas of a nozzle-shaped opening provided in the insulation body 4 (and closed by the moving contacts 3 in the engaged position) and of a nozzle-shaped opening provided in the fixed contact 2. The hot space 5 is preferably so dimensioned that its axial longitudinal extension and its radial depth measured from the entrance of the annular duct 6 into the hot space 5 are approximately equal.

In the gas blast switch shown in FIG. 1, the annular duct 6 passes almost exclusively in the radial direction through the inner of the two coaxially located boundary walls of the hot space 5 and enters at approximately equal distances from the radially extending boundary walls of the hot space 5. The distances $L_1$ between the entrance of the annular duct 6 and the upper and lower radially extending boundary walls of the hot space 5 are approximately equal to the radial depth D of the hot space 5.

During disengagement (right-hand part of FIG. 11), the contact 3, which is designed as a solid cylinder, is moved downwards. As soon as this contact comes out of engagement with the contact 2, which is designed as a nozzle tube, the switching arc 7 forms between the contacts 2 and 3. During the high current phase, the switching arc strongly heats the extinguishing gas located in the arc extinguishing zone 8 and its pressure consequently increases. The heated high pressure extinguishing gas flows, in the main, through the annular duct 6 into the hot space 5. This generates a circulation flow (indicated by arrows) in the hot space 5; this flow first forms mainly in the radial direction and then, after dividing at the outer coaxially formed boundary wall, moves into the upper and lower part of the hot space.

Mixing tests have shown that in a hot space 5, whose axial longitudinal extension $L_1$ and radial depth D—calculated in each case from the entrance of the annular duct 6 into the hot space 5—are approximately equal, and in which a powerful circulation flow can form because of a width B of the annular duct 6 which is substantially less than the axial longitudinal extension and the radial depth of the hot space 5, heated and cooled extinguishing gas are almost completely mixed within one half-wave during the interruption of an alternating current of 50 Hz.

After the high current phase, the mixed entinguishing gas located in the hot space 5 flows back via the annular duct 6 into the arc extinguishing zone 8 where it blasts onto the switching arc 7 and subsequently passes into an expansion space via the contact 2 designed as a nozzle tube and via an opening provided in the insulation body 4 and freed by moving contact 3.

Figure 2:
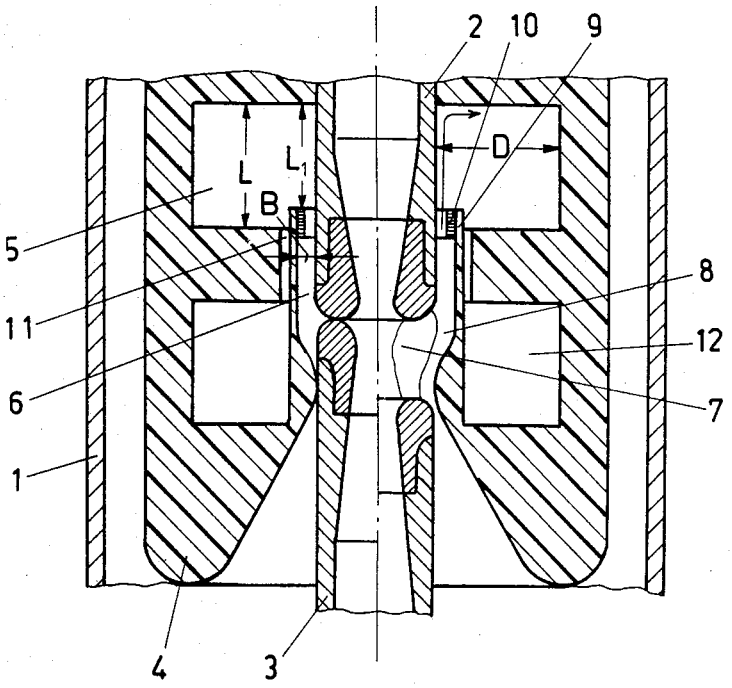
FIG. 2 shows a view of a second embodiment of a gas blast switch in accordance with the invention which is shown in a section along the axis of its contacts.

In the gas blast switch shown in FIG. 2, the annular duct 6 emerges tangentially to the inner of the two coaxially extending boundary walls of the hot space 5. By this means, a jet of heated extinguishing gas entering the hot space 5 during the high current phase is led in the axial direction along the boundary wall (right-hand part of FIG. 2), this generating a circulation flow which promote mixing of the heated and fresh extinguishing gas.

In addition, the annular duct 6 of the gas blast switch shown in FIG. 2 has a mouthpiece 9 extending along the inner of the coaxial boundary walls of the hot space 5 and a throat 10. By these means, the jet effect of the entering heated extinguishing gas and, therefore, the mixing of the heated and cool extinguishing gas is additionally reinforced.

A further improvement to the mixing is, in addition, achieved in that the hot space 5 of the gas blast switch shown in FIG. 2 communicates via a connecting duct 11 with a further space 12. The connecting duct 11 ends in the vicinity of the entry of the annular duct 6 and is located parallel to the annular duct 6. The flow cross-section of the connecting duct 11 and the size of the space 12 are so selected that when the pressure increases in space 5, the pressure in the space 12 lags behind the pressure in the space 5 by a substantial amount. This has the effect that, on the approach to the current crossover, a jet of comparatively fresh extinguishing gas emerges from the space 12 and this comparatively fresh extinguishing gas is additionally mixed with the premixed extinguishing gas flowing from the hot space 5. The same selection criteria as are used for the hot space 5 are preferably used for the entry of the connecting duct 11 into the space 12 and for the shape of the space 12 so as to achieve the best possible mixing of the heated and fresh extinguishing gas in the space 12.

Figure 3:
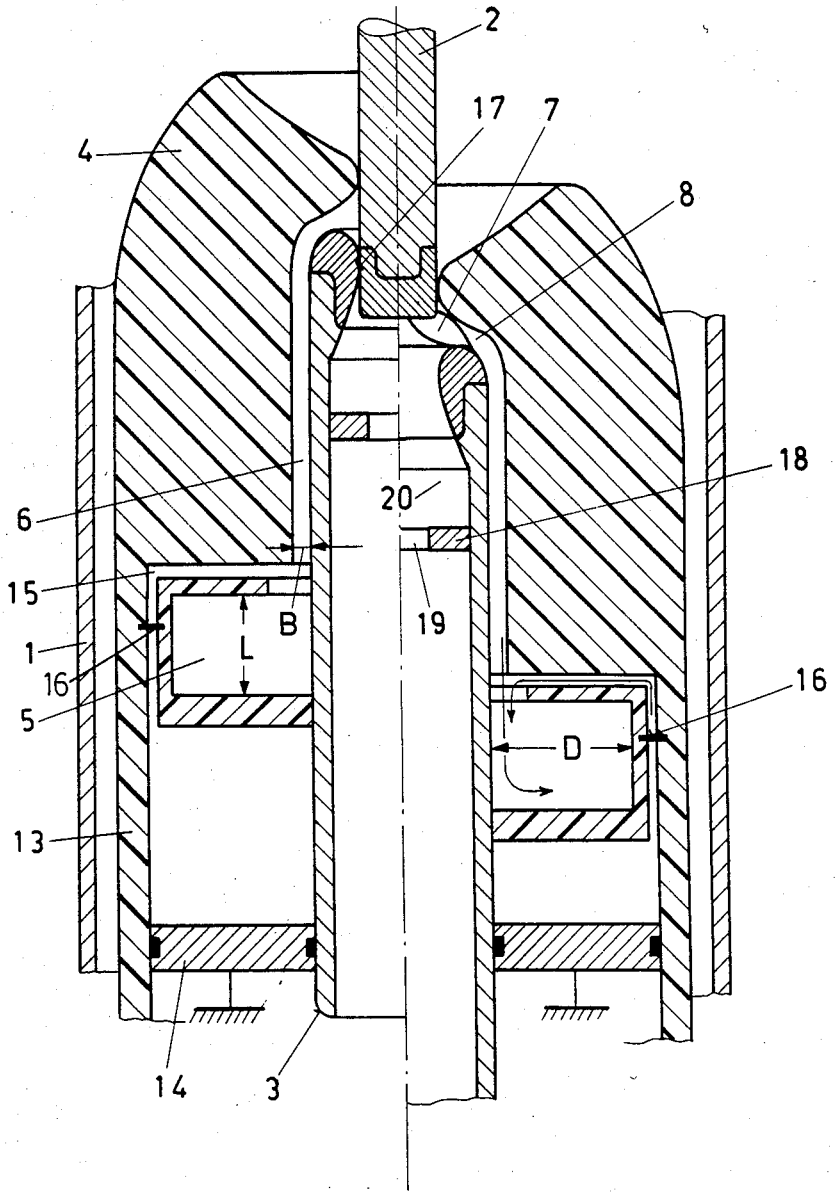
FIG. 3 shows a view of a third embodiment of a gas blast switch in accordance with the invention which is shown in a section along the axis of its contacts.

In the gas blast switch shown in FIG. 3, a device for compressing extinguishing gas is additionally provided. This device has a cylinder 13 connected to the moving contact 3 and a stationary piston 14 which can be axially displaced in a sealed manner in cylinder 13. During disengagement, the extinguishing gas located in cylinder 13 above piston 14 is compressed and introduced via supply duct 15 into hot space 5. The duct 15 emerges tangentially onto a radially extending boundary surface of the hot space 5. This embodiment of the gas blast switch achieves the result that during the high current phase (right-hand part of FIG. 3), the circulation flow in the hot space promotes mixing of heated extinguishing gas from the arc extinguishing zone 8 and fresh extinguishing gas from hot space 5 and from the compression device.

In order to prevent the entry of heated extinguishing gas into the compression device when high short-circuit currents are switched, a non-return valve 16 is provided in the duct 15.

Instead of entering on a radially extending boundary wall of hot space 5, duct 15 can also enter on an axially extending boundary wall of the hot space. The main consideration in routing duct 15 is that the extinguishing gas flowing from duct 15 during a switching procedure should have the same direction and sense as the extinguishing gas from annular duct 6 flowing in tangentially to a further boundary wall of the hot space 5 and circulating in hot space 5.

In the gas blast switch shown in FIG. 3, the moving contact 3 is hollow and forms, together with contact 2 in the engaged position (left-hand part of FIG. 3), a contact overlap with a contact surface 17. In the contact 3, there is—displaced downstream in the axial direction of the contact surface 17—a throat 18 with an opening 19 whose cross-section is smaller than the cross-section of the contact 3 opening surrounding the contact surface 17. The throat 18 terminates a space 20 limited by the upstream part of the contact 3, which space 20 supports the heat output of the switching arc 7 during disengagement and causes an increase in pressure in the hot space 5. To prevent return flow of overheated extinguishing gas from the space 20 into the arc extinguishing zone 8 during current crossover, the cross-section of the opening 19 is preferably so dimensioned that, at current crossover, the extinguishing gas from the space 20 emerges somewhat faster into the downstream part of the contact 3 than the extinguishing gas from the hot space 5 with the switch gap open.

I claim:

1. A gas blast switch, comprising:

a casing adapted to be filled with an arc extinguishing gas;

a hollow insulating body disposed within said casing and having a nozzle-shaped opening;

first and second generally cylindrically shaped contacts movable relative to one another along an axis of said casing, said first contact being disposed within said hollow insulating body and said second contact being mounted to close said nozzle-shaped opening of said hollow-insulating body when said first and second contacts are in a closed position, said insulating body defining an arc extinguishing zone which encloses a switching arc which develops between said first and second contacts when they are being disengaged from one another;

a toroid-shaped heating volume coaxially surrounding said first and second contacts, the heating volume having and being defined by at least an inner and an outer coaxially extending walls defined in said insulating body, and an annular duct for connecting said heating volume to said arc extinguishing zone, said heating volume further having an axial extension and a radial depth which are measured from a boundary between said heating volume and said annular duct, said axial extension and radial depth being generally equal to one another; and said annular duct extending generally radially with respect to said casing from said inner wall of said heating volume to said arc extinguishing zone, said annular duct having a width dimension which is smaller than said axial extension and radial depth of said heating volume.

2. Gas blast switch according to claim 1, characterised in that the annular duct emerges into the hot space approximately equally far from the substantially radially extending boundary walls of the hot space.

3. A gas blast switch, comprising:

a casing adapted to be filled with an arc extinguishing gas;

a hollow insulating body disposed within said casing and having a nozzle-shaped opening;

first and second generally cylindrically shaped contacts movable relative to one another along an axis of said casing, said first contact being disposed within said hollow insulating body and said second contact being mounted to close said nozzle-shaped opening of said hollow-insulating body when said first and second contacts are in a closed position, said insulating body defining an arc extinguishing zone which encloses a switching arc which develops between said first and second contacts when they are being disengaged from one another;

a toroid-shaped heating volume coaxially surrounding said first and second contacts, the heating volume having and being defined by at least an inner and outer coaxially extending walls defined in said insulating body, and an annular duct for connecting said heating volume to said arc extinguishing zone, said heating volume further having an axial extension and a radial depth which are measured from a boundary between said heating volume and said annular duct, said axial extension and radial depth being generally equal to one another; and said annular duct extending axially within said casing and generally tangentially about a boundary wall associated with said heating volume, said annular duct further having a width dimension which is smaller than said axial extension and radial depth associated with said heating volume.

4. Gas blast switch according to claim 3, further including an annular mouthpiece on the annular duct, the mouthpiece extending into the hot space.

5. Gas blast switch according to claim 4, characterised in that the annular duct has a throat in the region of the mouthpiece.

6. Gas blast switch according to claim 3, characterised in that the hot space is connected via a connecting duct with a further space.

7. Gas blast switch according to claim 6, characterised in that the annular duct and the connecting duct run parallel to one another and have inlets into the hot space located adjacent to one another.

8. Gas blast switch according to claim 3 further comprising a device for generating compressed extinguishing gas, said device being connected via a supply duct to the hot space, the annular duct and the supply duct entering tangentially onto at least one boundary wall of the hot space in such a way that during a switching procedure, extinguishing gas emerging from the two ducts circulates in the same direction and sense as in the hot space.

9. Gas blast switch according to claim 8, further including a nonreturn valve in the supply duct.

10. Gas blast switch according to claim 3 further including a throat within the second contact, said throat being located, in an engaged condition of said switch, displacedly in the axial direction relative to a contact surface of said first and second contacts and has a smaller opening cross-section than that of the opening of said second contact surrounding said contact surface.

* * * * *